US009220968B2

(12) United States Patent
Ritter

(10) Patent No.: US 9,220,968 B2
(45) Date of Patent: Dec. 29, 2015

(54) HEEL LOCK FOR SPLITBOARD BINDING INTERFACE

(71) Applicant: William J Ritter, Bozeman, MT (US)

(72) Inventor: William J Ritter, Bozeman, MT (US)

( * ) Notice: Subject to any disclaimer, the term of this patent is extended or adjusted under 35 U.S.C. 154(b) by 0 days.

(21) Appl. No.: 14/715,910

(22) Filed: May 19, 2015

(65) Prior Publication Data

US 2015/0343298 A1 Dec. 3, 2015

Related U.S. Application Data

(60) Provisional application No. 62/007,358, filed on Jun. 3, 2014.

(51) Int. Cl.

| | |
|---|---|
| ***A63C 9/00*** | (2012.01) |
| ***A63C 9/084*** | (2012.01) |
| ***A63C 10/12*** | (2012.01) |
| ***A63C 10/08*** | (2012.01) |
| ***A63C 5/03*** | (2006.01) |

(52) U.S. Cl.

CPC ..... *A63C 9/0846* (2013.01); *A63C 5/033* (2013.01); *A63C 10/08* (2013.01); *A63C 10/12* (2013.01)

(58) Field of Classification Search

CPC .. A63C 9/005; A63C 9/0846; A63C 2203/06; A63C 5/02; A63C 5/03

See application file for complete search history.

(56) References Cited

U.S. PATENT DOCUMENTS 2,433,161 A 12/1947 Schwarze
2,705,150 A 3/1955 Hansen
2,823,922 A * 2/1958 Berlenbach ..... A63C 9/0842 280/626
2,879,071 A 3/1959 King
3,326,565 A * 6/1967 Cubberley ..... A63C 9/082 280/620
3,379,447 A * 4/1968 Webster ..... A63C 9/08 280/623
3,471,161 A * 10/1969 Cubberley ..... A63C 9/0842 280/627
3,504,923 A * 4/1970 Berchtold ..... A63C 9/002 280/637
3,630,539 A * 12/1971 Lusser ..... A63C 9/08 280/626
3,630,559 A 12/1971 Lusser
3,754,769 A * 8/1973 King ..... A63C 9/005 280/631
3,787,062 A * 1/1974 Kusianovich ..... A63C 9/0805 280/632
3,893,682 A * 7/1975 Weinstein ..... A63C 9/0846 280/613
3,908,971 A * 9/1975 Engel ..... A63C 9/005 280/614
4,522,424 A * 6/1985 Luitz ..... A63C 9/005 24/68 SK
4,592,568 A * 6/1986 Priskich ..... A63C 9/00 280/607
5,271,649 A * 12/1993 Gromotka ..... E05C 19/14 292/113
5,518,264 A * 5/1996 Broughton ..... A43B 5/0492 280/615
5,649,722 A * 7/1997 Champlin ..... A63C 5/02 280/14.22
5,697,631 A * 12/1997 Ratzek ..... A63C 10/08 280/14.21

(Continued)

*Primary Examiner* — Brodie Follman

(74) *Attorney, Agent, or Firm* — K Karel Lambert; Lambert Patent Services

(57) ABSTRACT

A heel lock and release combination for a splitboard boot binding. For use in ski touring mode, the binding includes a baseplate for receiving a rider's boot and a spring clamp affixed to a ski member of a splitboard binding interface. The baseplate is pivotably affixed to the ski at the toe. The spring clamp is mounted on a heel rest and may be repositioned between a heel locking and a free heel position. When locked, the spring clamp engages the heel end of the baseplate and prevents heel release. The engagement of the spring clamp is configured so that release of the heel occurs under stress: reducing injury.

10 Claims, 12 Drawing Sheets

(56) References Cited

U.S. PATENT DOCUMENTS

| | | | | |
|---|---|---|---|---|
| 7,681,904 | B2 | 3/2010 | Ekberg | |
| 7,823,905 | B2 * | 11/2010 | Ritter | A63C 5/02 280/14.26 |
| 7,988,180 | B2 * | 8/2011 | Holzer | A63C 9/005 280/611 |
| 8,033,564 | B2 * | 10/2011 | Riepler | A63C 5/02 280/603 |
| 8,226,109 | B2 * | 7/2012 | Ritter | A63C 5/02 280/14.26 |
| 8,328,225 | B2 * | 12/2012 | Prigge | A63C 9/006 280/614 |
| 8,348,299 | B2 | 1/2013 | Ekberg | |
| 8,469,372 | B2 | 6/2013 | Kloster | |
| 8,708,371 | B2 * | 4/2014 | Balun | A63C 5/033 280/14.21 |
| 8,764,043 | B2 * | 7/2014 | Neubauer | A63C 10/16 280/607 |
| 9,022,412 | B2 * | 5/2015 | Ritter | A63C 5/02 280/14.26 |
| 9,079,094 | B2 | 7/2015 | Eckberg | |
| 2004/0187270 | A1 * | 9/2004 | Lee | A44B 11/25 24/170 |
| 2008/0122202 | A1 * | 5/2008 | Furr | A63C 10/12 280/626 |
| 2009/0072519 | A1 | 3/2009 | Hutchinson | |
| 2012/0274036 | A1 | 11/2012 | Kloster | |

* cited by examiner

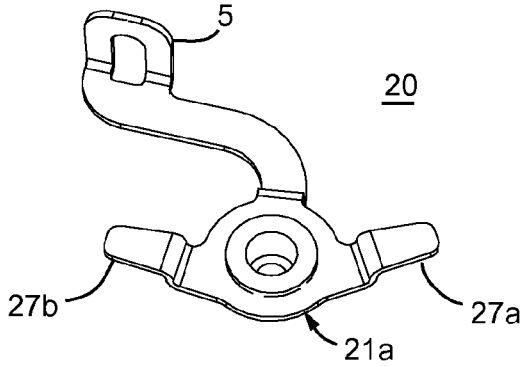
Fig. 6A
Fig. 6B
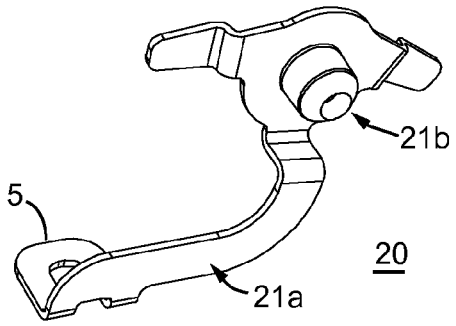
Fig. 6C
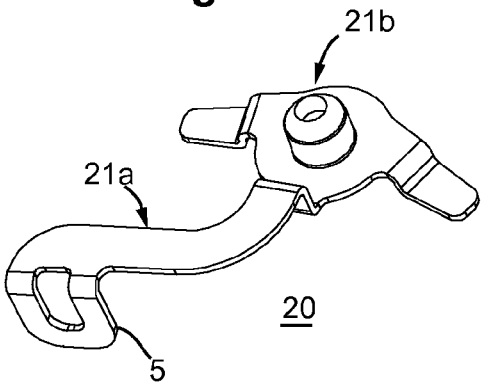
Fig. 6D
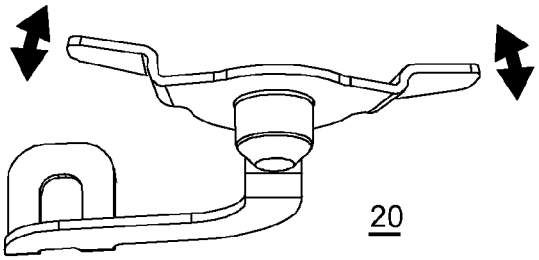
Fig. 7A
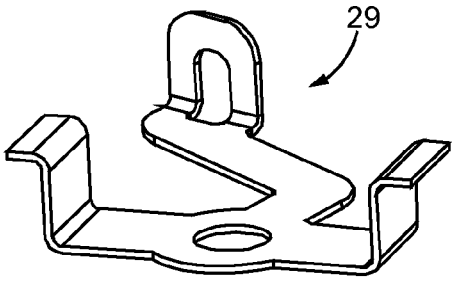
Fig. 7B
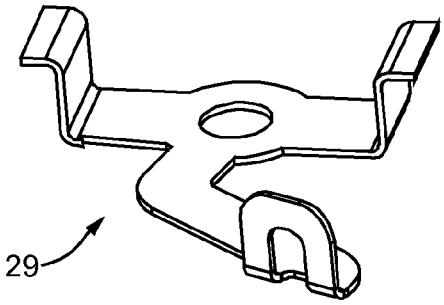

HEEL LOCK FOR SPLITBOARD BINDING INTERFACE

FIELD OF THE INVENTION

The embodiments of the present invention relate to an improved heel lock for use with splitboard boot bindings.

BACKGROUND

Splitboarding is unique in winter sports because it combines elements of skiing and snowboarding. A splitboard looks like a snowboard when fully assembled, but can be taken apart to be used as a pair of skis—the board is split lengthwise and each board half is a ski when separated. Splitboards typically include a ski binding interface and a splitboard binding interface such that a single pair of boot bindings is used to mount the rider's boots on either interface. Thus the rider can switch the bindings between a ski touring mode and a snowboard riding mode at will. In snowboard riding mode, with both feet spread apart on a board, the knee injuries that plague skiers are significantly reduced, but safety issues with ski touring mode remain.

In ski touring mode, there is a need for a fixed heel binding, for example when using climbing skins, when sidestepping up on steep slopes, and on a downhill ski run. A heel lock mechanism permits the rider to be more aggressive in turning and carving with the ski edges, improving performance. Wariakois in U.S. Pat. No. 5,984,324 suggested inserting a locking pin into the boot binding baseplate at the heel. However, skiing in this way, with no possible release, subjects the rider to risk of injury, such as an Achilles tendon tear or detachment. When the heel is locked to a ski, injury can result if the ski tip is levered toward the knee resulting in ankle hyperflexion, such that the heel tendon may be pulled from the calcaneus or torn in the hypovascular zone intermediate to the gastrocnemius. If the tendon is torn away with a bit of bone attached, the injury has a good prognosis, but soft tissue damage from a muscle or tendon tear typically takes a longer time to recover. Such tears may result in prolonged disability and the prospect of lifelong pain and weakness.

To reduce the safety hazard of locked heel skiing, skiers have developed alpine touring heel release technology. Breakaway mechanisms detach the boot at the heel when the torsional forces on the heel exceed a pre-selected threshold. The release threshold is adjusted according to the size, skill and physique of the user so as to prevent unnecessary release and sudden falls. A range of DIN settings is offered by each manufacturer and is dependent on a clamp that engages a hard boot worn by the rider.

Hard boot technology developed for skiing is not generally adapted for splitboarding because of the widespread preference for soft boots. Riders have increasingly opted to wear soft boots and use toe and ankle straps in combination with a heel cup to secure their leather boots to a baseplate. The baseplate is mounted on a toe pivot interface in ski touring mode or on a snowboard interface in snowboard ride mode. The baseplate can be rapidly interchanged between the two interfaces, and should also function for use with climbing bars and crampons. These complications dictate that any safety release mechanism for splitboarding is subject to a unique set of problems not encountered with alpine ski equipment.

Thus there is an unmet need for a splitboard boot binding means that will automatically disengage a rider's heel when the torsional force on the rider's foot exceed a safe level, but is otherwise stable and secure so as to avoid inadvertent and unnecessary disengagement. Also advantageous would be a release device that is readily reassembled and re-used after a release event, is easily engaged and disengaged with a ski pole or a gloved hand, is compatible with climbing bars and crampons, and—does not interfere with the essence of splitboarding, the capacity to easily switch between ski touring and snowboard ride modes.

SUMMARY

Disclosed is a heel lock and release combination for use with splitboards in ski touring mode. The mechanism is synergic with existing ski touring and snowboard ride interfaces and with the soft boot baseplates preferred by splitboarders. A heel rest bracket with spring clamp is mounted on each ski under the rider's heel such that the spring clamp engages contralateral flanges or teeth on the underside of the baseplate and prevents heel release. The spring clamp is moveable between a first position in which it engages locking surfaces of the flanges (a "heel lock position") and a second position in which the heel is unlocked (a "free heel position"). Surprisingly, a release threshold at 125 pounds of pull force (about 125 lb or 550 N) on the pivot tangent is high enough so as prevent inadvertent disengagement but is low enough so that the risk of injury is reduced.

To use the invention, the rider straps a soft boot on a baseplate mounted on a ski touring interface and engages the heel lock by engaging the spring clamp arms on the flange teeth of the baseplate. The baseplate is designed to pivot at the toe or may be locked to the ski using the spring clamp arms. A locked heel enables the rider to better transmit force applied during turns and carving when skiing. However, the heel lock is designed to reversibly snap free from the heel rest if a pull force on the ski or heel exceeds a safe level. Use of the heel lock assists the rider in avoiding serious injury to the Achilles tendon or gastrocnemius. A control or selector arm is supplied that allows the rider to move the clamp, such as with a ski pole, between the heel lock position and the free heel position according to conditions and skiing style.

Thus more generally, in a first aspect, the invention is an improved ski touring interface for use with a splitboard binding, the ski touring interface comprising a heel lock and release combination having a spring clamp configured to release the heel end of said binding when subjected to an unsafe critical pull force at the heel thereof. The invention is compatible with splitboards having dual interfaces for splitboard riding mode and ski touring mode. More particularly, a heel lock and release combination is added to the ski touring interface. The combination comprises a baseplate member having a toe pivot and an underside channel, the underside channel having an underside anchor tooth or teeth disposed at the heel end of the baseplate. The invention is further characterized by (i) a heel rest bracket mounted on each ski member under the heel end of the boot binding baseplate, and (ii) a spring clamp moveably positioned on said heel rest bracket; wherein the spring clamp is moveable between a heel lock position and a free heel position such that, in the heel lock position, the spring clamp is configured with an arm or arms to engage the underside anchor tooth or teeth, thereby locking the heel to the ski; and to release the heel from the heel lock position when a rider's heel is subjected to a critical pull force established as a safety threshold. The spring clamp of the heel lock and release apparatus is reversibly movable from the heel lock position to the free heel position by a rotating motion, a bending motion, or a sliding motion. In more particular embodiments, the heel lock and release apparatus for a splitboard ski touring interface comprises: (a) a boot binding baseplate having a toe end and a heel end, wherein said toe end is configured to attach to a toe pivot of a ski touring interface and said heel end comprises contralateral anchor teeth disposed inferiorly thereon, said anchor teeth having a defined lateral separation distance; further characterized by (b) a spring clamp body configured to attach to a ski member of a splitboard under the heel end of the boot binding baseplate, the spring clamp body having a heel lock lever or tab for moving the spring clamp body from a free heel position to a heel lock position and two spring arms conjoined thereto, each spring arm having a tip end, wherein the tip ends are configured to span the lateral separation distance when engaged on the anchor teeth in the lock position; and, wherein the spring clamp arms are elastically deformable, such that the tip ends are enabled to disengage from the anchor teeth when a toe pivot force on the anchor teeth exceeds a release threshold. The leaf spring clamp is formed of a folded spring steel. The tip ends seat on the anchor teeth in the lock position so as to clampingly prevent a pivot of the baseplate on the toe pivot when not stressed, and elastically deform so as to unseat from the anchor teeth when stressed by a toe pivot force exceeding a safety limit or threshold defined as a force below the tensile failure strength and stretchability of a rider's Achilles tendon. As experimentally determined, the preferred safety threshold or critical pull force is about 125 lb (556 N).

The elements, features, steps, and advantages of the invention will be more readily understood upon consideration of the following detailed description of the invention, taken in conjunction with the accompanying drawings, in which presently preferred embodiments of the invention are illustrated by way of example.

It is to be expressly understood, however, that the drawings are for illustration and description only and are not intended as a definition of the limits of the invention. The various elements, features, steps, and combinations thereof that characterize aspects of the invention are pointed out with particularity in the claims annexed to and forming part of this disclosure. The invention does not necessarily reside in any one of these aspects taken alone, but rather in the invention taken as a whole.

BRIEF DESCRIPTION OF THE DRAWINGS

The teachings of the present invention are more readily understood by considering the drawings, in which:

FIG. 1A illustrates a single ski member; FIG. 1B a complete splitboard having two ski members.

In FIG. 4A, a section lengthwise through the baseplate is cut so as to expose the underlying mechanism as depicted in FIGS. 4B and 4C.

FIGS. 6A, 6B, 6C, and 6D are perspective detail views of a spring clamp subassembly. The clamp member includes stainless spring steel wings, a center hub that inserts into the heel rest bracket, and a heel lock control lever.

FIGS. 7A and 7B are perspective detail views of an alternate butterfly spring clamp.

Figure 1A:
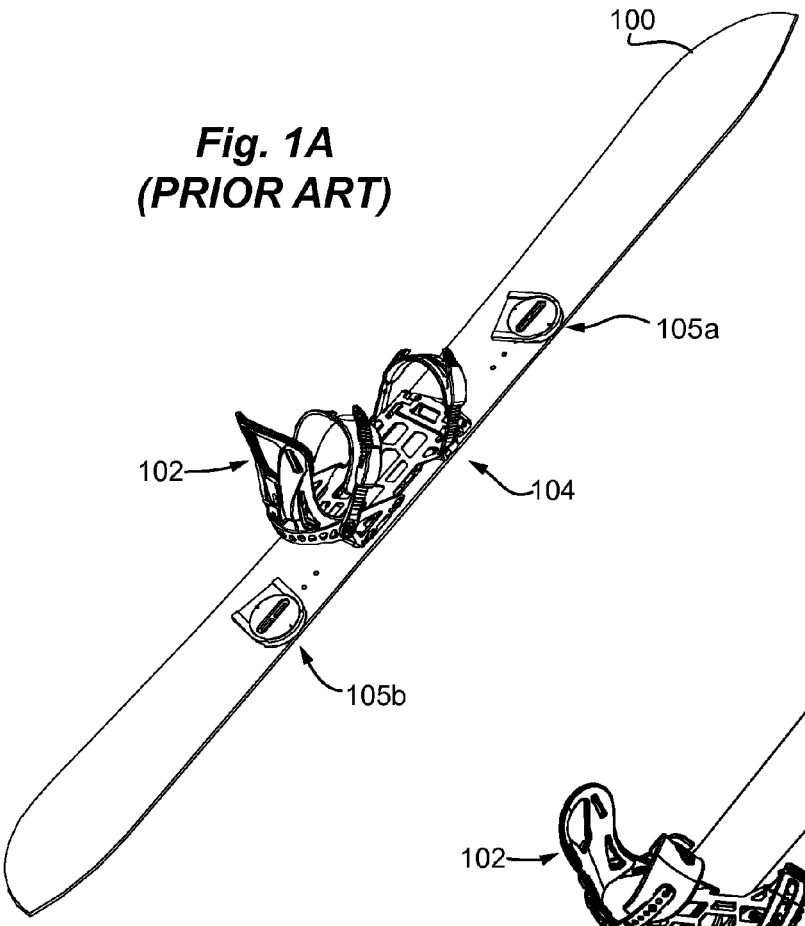
Fig. 1A (PRIOR ART)
FIGS. 1A and 1B are views of prior art splitboard bindings and binding interfaces. Shown are a ski touring interface and a snowboard ride interface.

The drawing figures are not necessarily to scale. Certain features or components herein may be shown in somewhat schematic form and some details of conventional elements may not be shown in the interest of clarity, explanation, and conciseness. The drawing figures are hereby made part of the specification, written description and teachings disclosed herein.

GLOSSARY AND NOTATION

Certain terms are used throughout the following description to refer to particular features, steps or components, and are used as terms of description and not of limitation. As one skilled in the art will appreciate, different persons may refer to the same feature, step or component by different names. Components, steps or features that differ in name but not in structure, function or action are considered equivalent and not distinguishable, and may be substituted herein without departure from the invention. Certain meanings are defined here as intended by the inventors, i,e., they are intrinsic meanings. Other words and phrases used herein take their meaning as consistent with usage as would be apparent to one skilled in the relevant arts. The following definitions supplement those set forth elsewhere in this specification.

"Splitboard"—when fully assembled a splitboard has the shape of a snowboard, but the board is split lengthwise down the middle and each board half is functional as a ski when separated. Splitboards typically include a ski touring interface and a splitboard ride interface such that a single pair of boot bindings is used to mount the rider's boots on either interface. Thus the rider can switch the bindings between a ski touring mode and a snowboard riding mode at will. In snowboard riding mode, the rider faces right or left and puts one foot in front of the other when strapping in. In ski touring mode, the rider's feet are generally centered on the ski members and move independently. Ski touring mode can include "free heel" skiing as is familiar to Telemark, skate ski and cross-country skiers, or Alpine skiing with locked heels.

General connection terms including, but not limited to "connected," "attached," "conjoined," "secured," and "affixed" are not meant to be limiting, such that structures so "associated" may have more than one way of being associated. In general, fasteners such as bolts and pins as would be known to one skilled in the art are omitted in the drawings for clarity.

Relative terms should be construed as such. For example, the term "front" is meant to be relative to the term "back," the term "upper" is meant to be relative to the term "lower," the term "vertical" is meant to be relative to the term "horizontal," the term "top" is meant to be relative to the term "bottom," and the term "inside" is meant to be relative to the term "outside," and so forth. Unless specifically stated otherwise, the terms "first," "second," "third," and "fourth" are meant solely for purposes of designation and not for order or for limitation. Reference to "one embodiment," "an embodiment," or an "aspect," means that a particular feature, structure, step, combination or characteristic described in connection with the embodiment or aspect is included in at least one realization of the present invention. Thus, the appearances of the phrases "in one embodiment" or "in an embodiment" in various places throughout this specification are not necessarily all referring to the same embodiment and may apply to multiple embodiments. Furthermore, particular features, structures, or characteristics of the invention may be combined in any suitable manner in one or more embodiments.

It should be noted that the terms "may," "can," and "might" are used to indicate alternatives and optional features and only should be construed as a limitation if specifically included in the claims. The various components, features, steps, or embodiments thereof are all "preferred" whether or not it is specifically indicated. Claims not including a specific limitation should not be construed to include that limitation. The term "a" or "an" as used in the claims does not exclude a plurality.

"Conventional" refers to a term or method designating that which is known and commonly understood in the technology to which this invention relates.

Unless the context requires otherwise, throughout the specification and claims that follow, the term "comprise" and variations thereof, such as, "comprises" and "comprising" are to be construed in an open, inclusive sense—as in "including, but not limited to."

The appended claims are not to be interpreted as including means-plus-function limitations, unless a given claim explicitly evokes the means-plus-function clause of 35 USC §112 para (f) by using the phrase "means for" followed by a verb in gerund form.

DETAILED DESCRIPTION

Figure 1B:
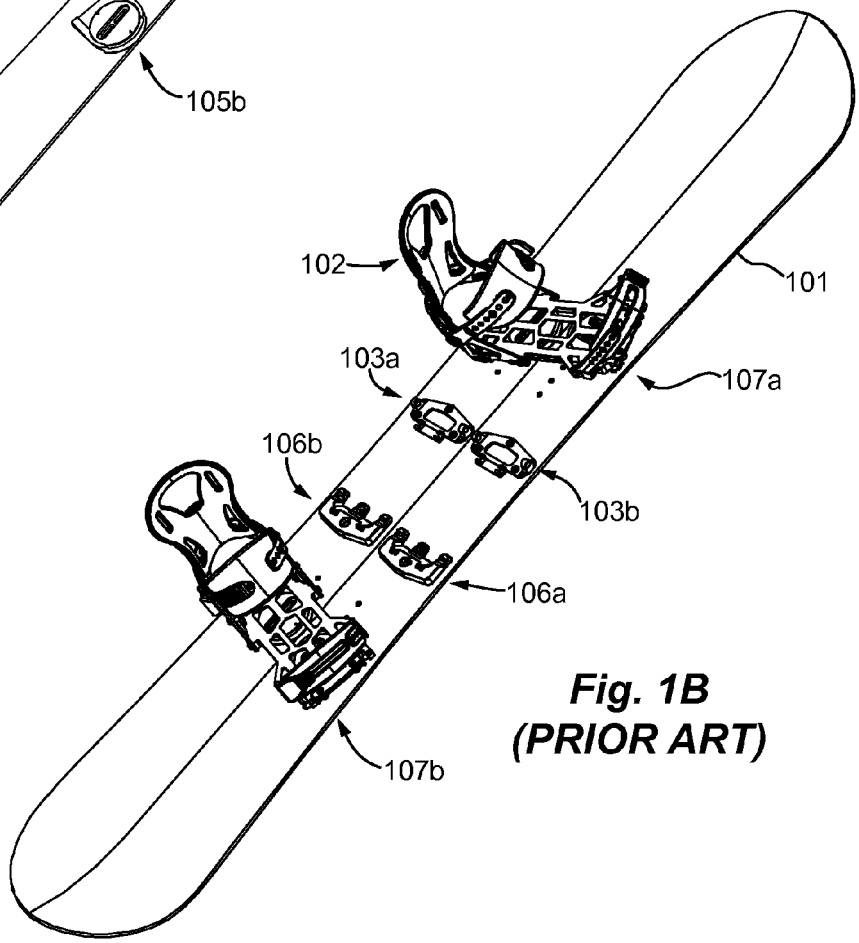
Fig. 1B (PRIOR ART)

FIGS. 1A and 1B are views of prior art splitboard boot bindings and binding interfaces. Shown are a ski touring interface and a snowboard ride interface. FIG. 1A illustrates a ski member 100; FIG. 1B a complete splitboard 101. As known in the art, for ski touring mode, a rider will mount boot bindings 102 on a ski touring interface 104. The ski touring interface includes a pair of toe pivot brackets (103*a*, 103*b*) and a pair of heel rest brackets (106*a*, 106*b*). For snowboard ride mode, a rider will mount boot bindings 102 on a snowboard ride interface (107*a*, 107*b*) as known in the art. The snowboard ride mode interface with attached boot bindings is shown in FIG. 1B and is formed by conjoining pairs of slider pucks (105*a*, 105*b*).

Representative ski touring and snowboard ride interfaces are described in more detail in U.S. Pat. No. 5,984,324 to Wariakois and in U.S. Pat. Nos. 7,823,905, 8,226,109 and 9,022,412 to Ritter. Alternate toe pivot assemblies usable with the invention are described in WIPO Pat. Appl. No. PCT/US2013/078477 to Ritter, which is co-owned and co-pending. Other suitable toe pivot assemblies for practice of the inventive heel lock means are described for example in US Pat. Publ. Nos. 2012/0274036 to Kloster and US2013/0341889 to Neubauer. All said patent documents are hereby incorporated herein in full by reference for all purposes. Generally, any toe pivot means for use in ski touring mode on a splitboard is compatible with the heel lock means of the invention. Conventional features of a boot binding, such as a toe and ankle strap, heel loop and highback, are shown for completeness but are not part of the heel lock and release mechanism of the invention.

Figure 2A:
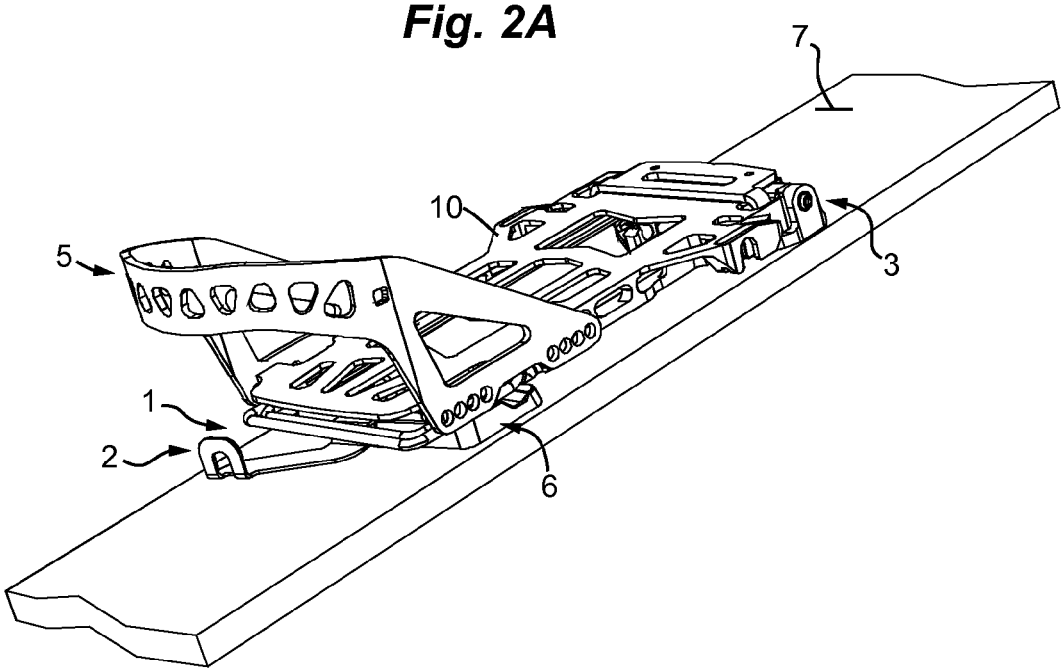
FIGS. 2A and 2B are perspective and elevation views of a splitboard ski touring interface with heel lock and release combination of the invention.
Figure 2B:
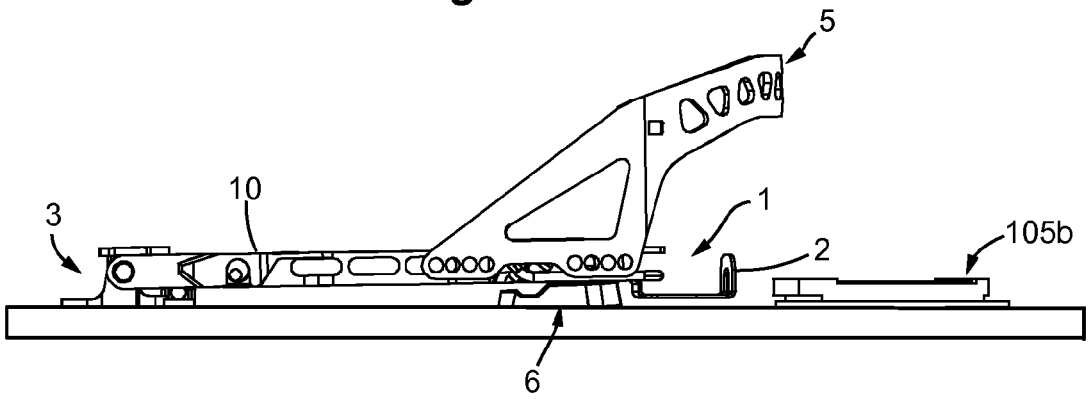

FIGS. 2A and 2B are perspective and elevation of a splitboard ski touring interface with heel lock and release combination 1. Attached to the interface is a boot binding baseplate 10, shown here with a heel cup 5. The baseplate attaches to a toe pivot bracket 3. The heel lock and release mechanism includes a heel release lever 2 that is rotatably mounted in heel rest bracket 6. These elements are shown again in FIG. 2B. More detail is provided below. Also shown is a side view of a puck 105*b* that shares the ski member with the toe pivot and heel rest of the ski touring interface, which functions in joining the ski members together at the centerline in splitboard ride mode as known in the art.

Figure 3A:
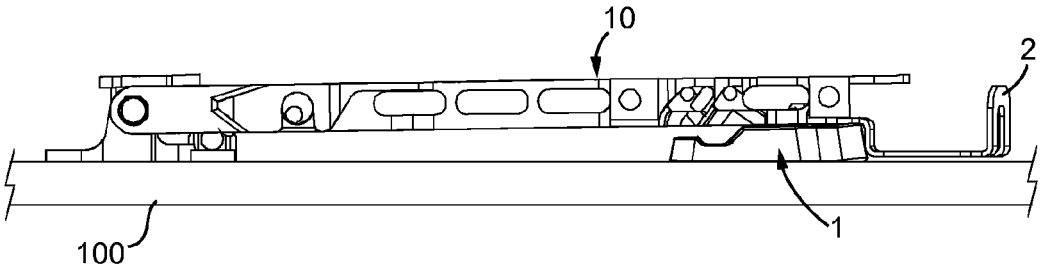
FIGS. 3A, 3B and 3C are elevation and plan views of a boot binding on a ski touring interface, showing the toe pivot action and a cutline for the sectional plane depicted in FIG. 4A.
Figure 3B:
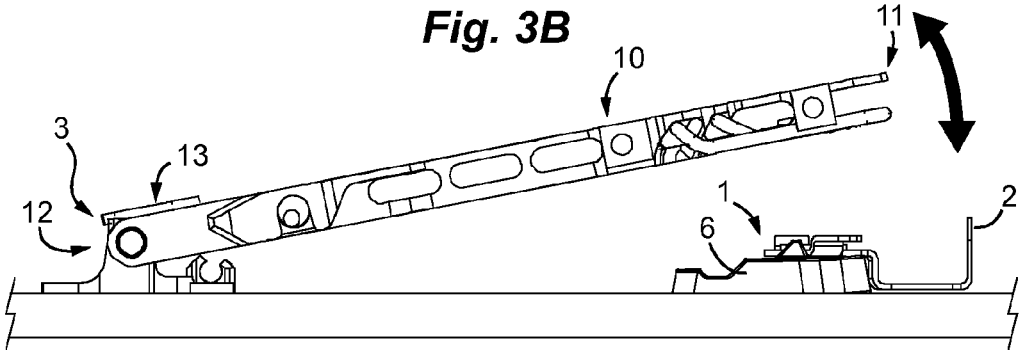
Figure 3C:
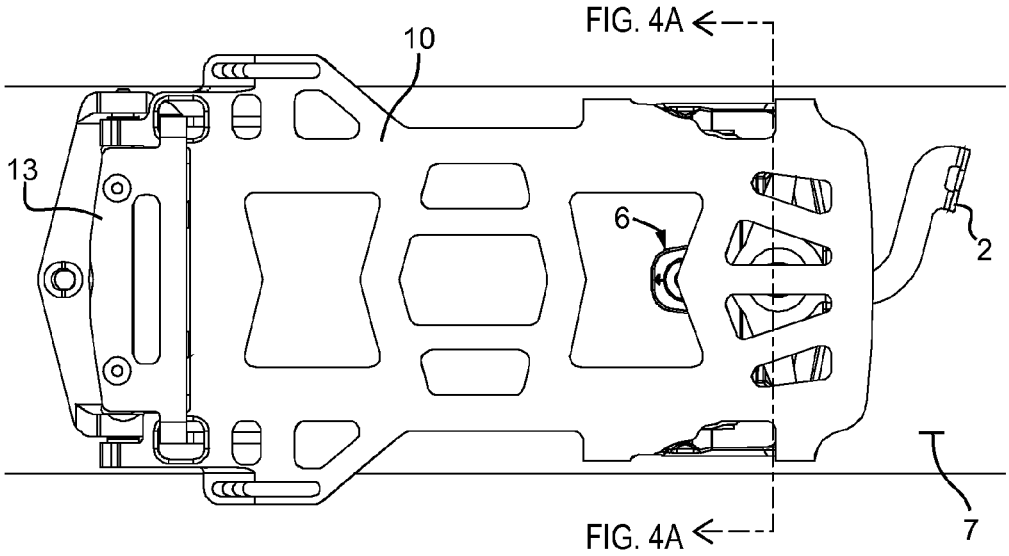

FIGS. 3A, 3B and 3C are elevation and plan views of a boot binding baseplate assembly in which the heel cup is omitted. The heel lock and release mechanism 1 is shown under the baseplate 10. The toe pivot action on the ski member is illustrated in FIG. 3B (bold arrow). The boot binding baseplate 10 includes a heel end 11, which pivots on a toe end 12 with respect to the ski member and is dimensioned to support a rider's boot. The heel lock and release combination 1, including heel lock lever 2 and heel rest bracket 6, and are shown in side view and plan view as attached to the top face 7 of the ski member 100. As drawn here, the toe pivot includes a latch pedal 13 and pintle pin pivot as disclosed in US Pat. Appl. Publ. No. 2014/0210187, titled "Boot Binding System with Foot Latch Pedal", which is co-owned and co-pending. Also shown is a cutline for the sectional view of FIG. 4A.

The toe pivot assembly allows the rider's boot to pivot for free heel skiing, for cross-country, and for climbing in ski touring mode. The heel lock assembly is provided with a heel lock lever 2 for securing or releasing the heel end of the baseplate. A heel rest 6 is provided so that the baseplate is generally level from toe pivot end 12 to heel end 13.

Figure 4A:
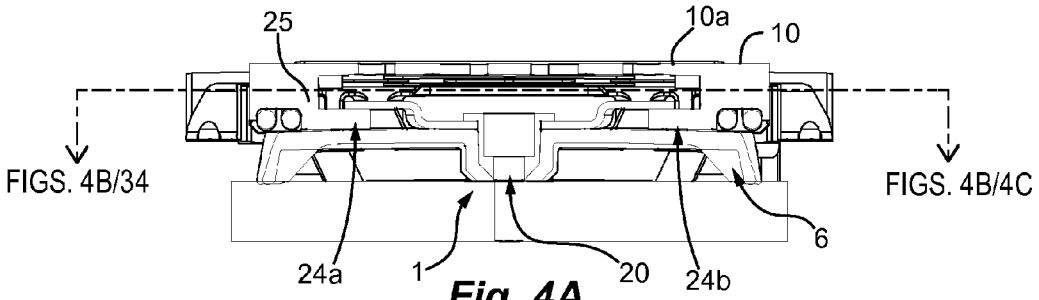
FIGS. 4A, 4B and 4C are views illustrating a first heel lock and release mechanism.
Figure 4B:
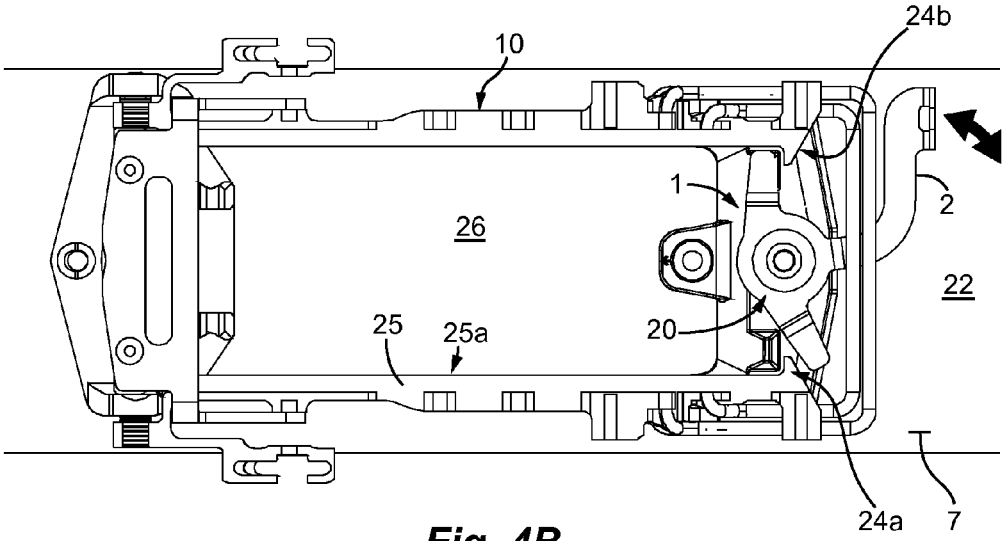
Figure 4C:
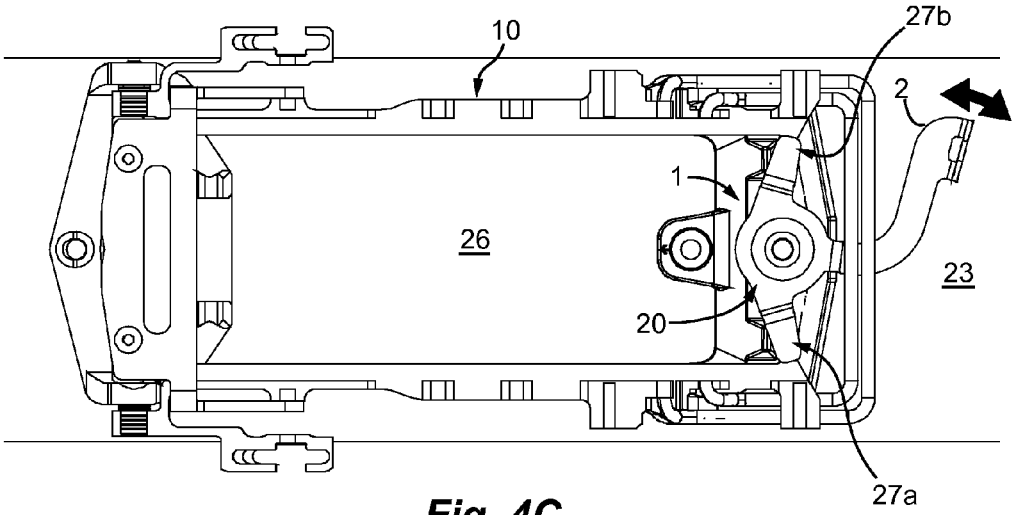

FIGS. 4A, 4B and 4C are introductory views illustrating the heel lock and release spring mechanism 1. Sectional view FIG. 4A is drawn through the heel release 1 and heel bracket 6 at a butterfly spring clamp assembly 20. Spring clamp arms (27*a*, 27*b*) seat on anchor teeth (24*b*, 24*a*). By rotation of heel lock lever 2, the tip ends of the spring arms can be engaged or disengaged on the anchor teeth. Heel lock lever 2 rotates the butterfly spring clamp body between the two positions. The anchor teeth are part of bilateral inside flanges on the underside of the baseplate 10; the flanges define a center channel 26 in under the top plate section 10*a*. In FIG. 4A, a section lengthwise through the baseplate is cut so as to peel off the top surface 10*a* of the baseplate 10 (as shown in FIGS. 4B and 4C) and expose the spring mechanism.

FIG. 4B shows a "free heel position" (22) of the "butterfly" spring assembly 20 as rotated by a heel lock lever; FIG. 4C shows the butterfly spring assembly 20 in a "heel lock position" (23) as locked over the contralaterally disposed anchor teeth that projecting internal into an underside channel 26 in the baseplate. The anchor teeth (24*a*, 24*b*) are extensions of an inside flange 25*a* on each web member 25, and also serve as stops when engaging the slider pucks in splitboard riding mode. In this view the underside channel is blocked at the heel end by the anchor teeth and at the toe end by the toe latch pedal assembly 13.

In FIG. 4C, laterally projecting prongs or "wings" (27*a*, 27*b*) of the butterfly spring member 21*a* are seen to be superimposed on the anchor teeth depicted in FIG. 3B. The two elements (24*a* and 27*a*, 24*b* and 27*b*) are in contact in the heel lock position 23, preventing the baseplate from pivoting on the toe pivot. The contact area between the spring member and the anchor teeth defines an interference seat (more distinctly illustrated in FIG. 8, 28*a*, 28*b*, which includes a perspective view of the interference seating, 28*a*, 28*b*). The bent or "folded" leaf spring arms are configured to engage the anchor teach of the underside inside flanges of the baseplate.

Figure 5A:
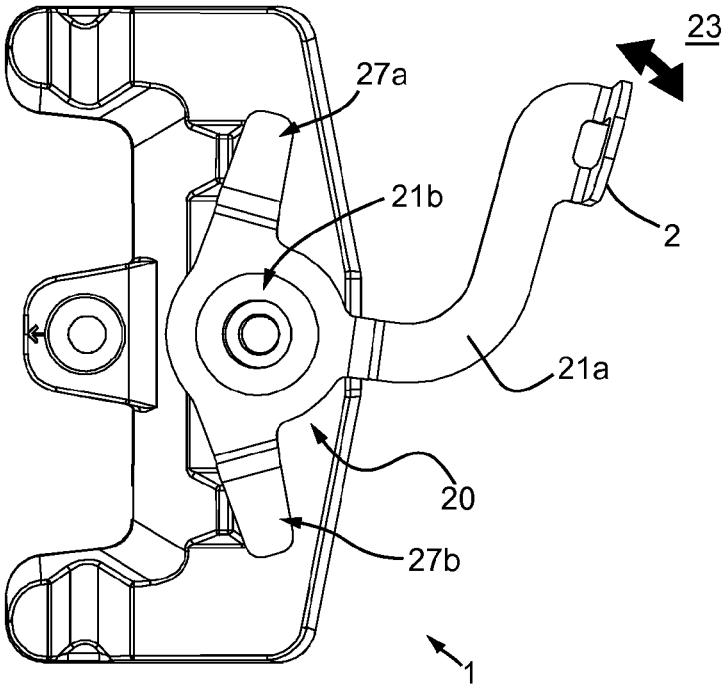
FIGS. 5A and 5B are perspective views showing the rotary action of a spring clamp member between the locked and free heel position on a heel rest bracket.
Figure 5B:
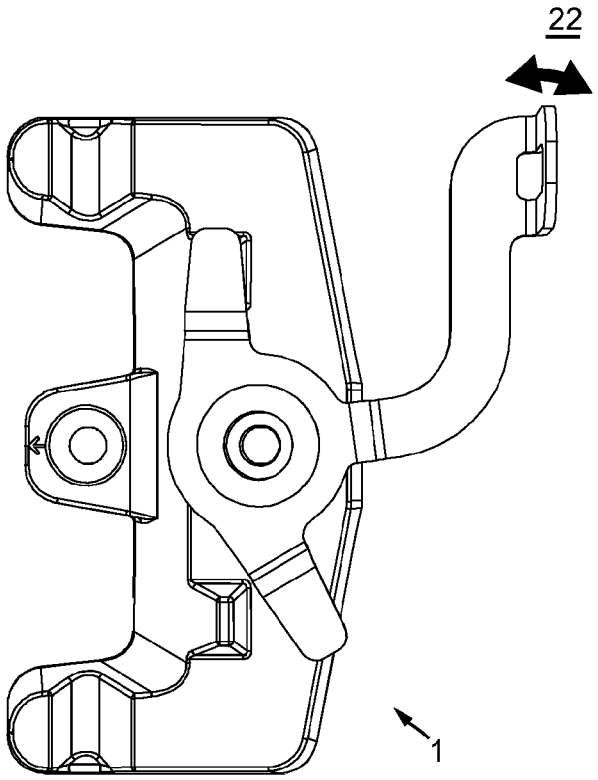

FIGS. 5A and 5B are perspective views showing the rotary action of a lever arm or tab 2 and spring clamp assembly 20 in the locked and free heel position on the heel rest bracket 6. The butterfly leaf spring arm tip ends (or "prongs" 27*a*, 27*b*) rotate on a hub assembly 21*b* from the heel lock position 23 to free heel 22 position. The heel rest bracket 6 with journaled centertap for support the hub is bolted to the ski surface, and may also include a detent pin or ball for stabilizing the spring assembly 20 in the locked and unlocked positions, for example. Equivalently, the detent may be formed in the heel rest bracket and engage the underside of the butterfly prongs in the locked position. In other instances, the prongs and their seat on the anchor teeth are matedly grooved so that the tips snap into the locked position until or unless the rider rotates the wings to the unlocked position. The tip ends are unlikely to disengage unless by an upward pull or "release force" exceeding the spring release threshold.

In another option, a coil spring may be used to engage a heel locking lever that rides on an anchor tooth on the baseplate. A cam action results in release when the release force overcomes the restorative spring force of the coil spring. By the same principles, spring loaded jaws with a pincer action on the anchor teeth (or a transverse anchor bar) may also be used. These alternatives are configured to have in common the preferred release force threshold derived experimentally as disclosed here (see EXAMPLE 1 and FIG. 14). Also conceived is a locking mechanism having a spring release, the locking mechanism having a track for slideably engaging the anchor teeth (or an anchor rod or flange extending across the posterior aspect of the baseplate). The spring clamp slides from a locked position to an unlocked position and is described in FIGS. 12A, 12B and 13.

FIGS. 6A, 6B, 6C and 6C are perspective views of the butterfly spring clamp assembly 20 with butterfly ("folded") leaf spring member 21*a* (generally made of spring steel), center hub member 21*b* (generally made of aluminum), and heel lock control surface 2. For the butterfly spring member 21*a*, and for prong members (27*a*, 27*b*), the material may be stainless steel 17-4 or equivalent, for example. Preferred spring members may be coated or layered to be water repellant, tarnish resistant, and self-lubricating. The hub may include a washer or a lubricious top coat so as to improve the smoothness of the heel lock lever 2 rotatory action.

FIG. 6D is a perspective view illustrating the flexural spring properties of the butterfly wing or "prong" members (27*a*, 27*b*). Shown is a spring action view (bold arrows) as occurs when the baseplate of the boot binding snaps free from the ski under overload stress conditions. In a locked position, the anchor teeth are restrained by the interference of the seated prongs. However, as the wing members flex up (bold arrows), the butterfly clamp wings may slip between the rigid anchor teeth, allowing the baseplate to snap free and pivot. This occurs only when a critical safety threshold is exceeded by an applied force, and may result in a loss of rider's balance, but is preferable to need for medical attention as the result of an injury. By selecting a steel having an elastic modulus in the desired range, the butterfly clamp will rebound to its relaxed state after a snap release, and may be reused simply by turning the heel lock lever to the "free heel position", pivoting the baseplate so that the heel end rests on the heel rest bracket, and then re-engaging the butterfly wings on top of the anchor teeth. Alternatively, the heel lock lever may be rotated free of any interference and then turned to the lock position once the anchor teeth are in position under the tip ends of the prongs.

Figure 15:
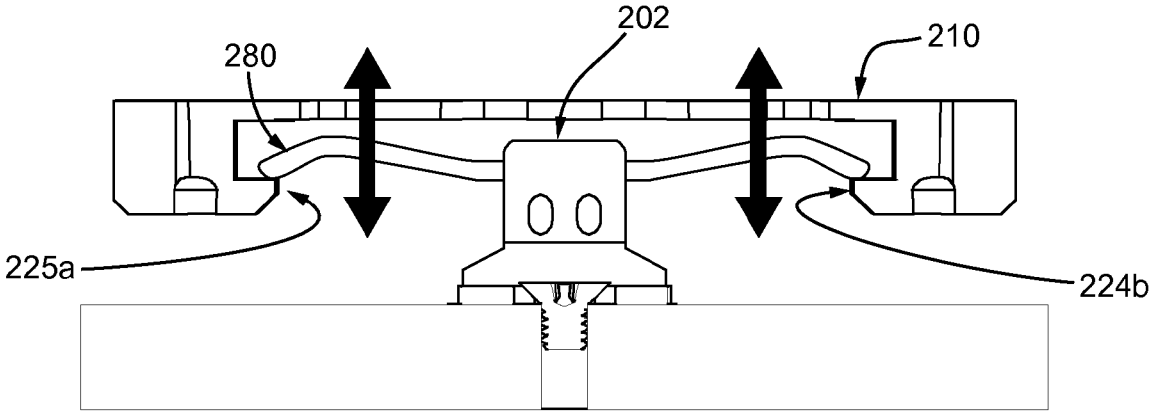
FIG. 15 depicts a yoke spring clamp having an elbow for reversibly disengaging and engaging according to the direction of a pull force on the spring arms.

FIGS. 7A and 7B are perspective views of an alternate spring clamp member 29 that functions to release the internal flange or anchor teeth when the boot binding baseplate is subjected at the heel to a pull force exceeding a critical threshold. While presented as a folded leaf spring, coil springs may also be used such that a cam or clamping pin is released from the spring clamp when a pull force is exceeded. Other bent springs are also envisaged as shown in FIG. 15.

Figure 8:
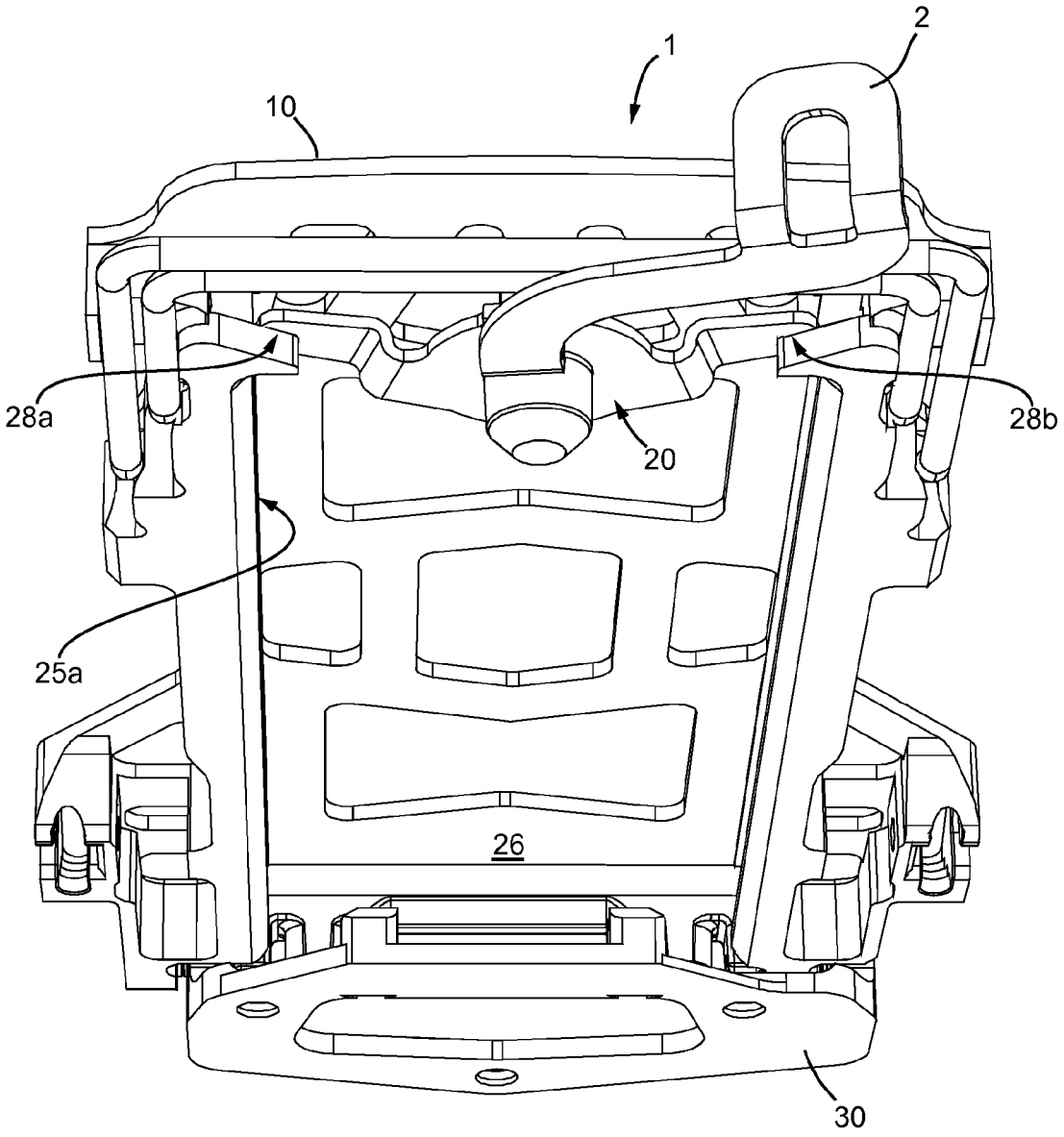
FIG. 8 is an underside perspective view of the baseplate showing the butterfly wings of the spring clamp engaged on the contralaterally disposed teeth, as would be viewed when the baseplate is locked onto the heel rest. Also shown is a toe pivot bracket of the ski touring interface.

FIG. 8 is an underside perspective view showing the butterfly wing members engaged on the contralaterally disposed teeth of the baseplate, as would be viewed when the baseplate is locked onto the heel rest. In this view, the parts themselves are not labelled, interference seats (28*a*, 28*b*) are marked to indicate that the spring steel prongs prevent the anchor teeth from rotating on the toe pivot. Also shown is a toe pivot cradle bracket 30 with mounting holes for attachment to the top face of a ski member.

The anchor teeth are seen to be projections of a bottom flange that defines each side of an internal channel 26. This channel is dimensioned to receive the slider pucks; the flange interlockedly engages a mating flange on the outside edge of each slider puck (e.g., 105*b*) for a tight grip when wedged between the toe pivot assembly 3 and the anchor teeth (24*a*, 24*b*).

Figure 9:
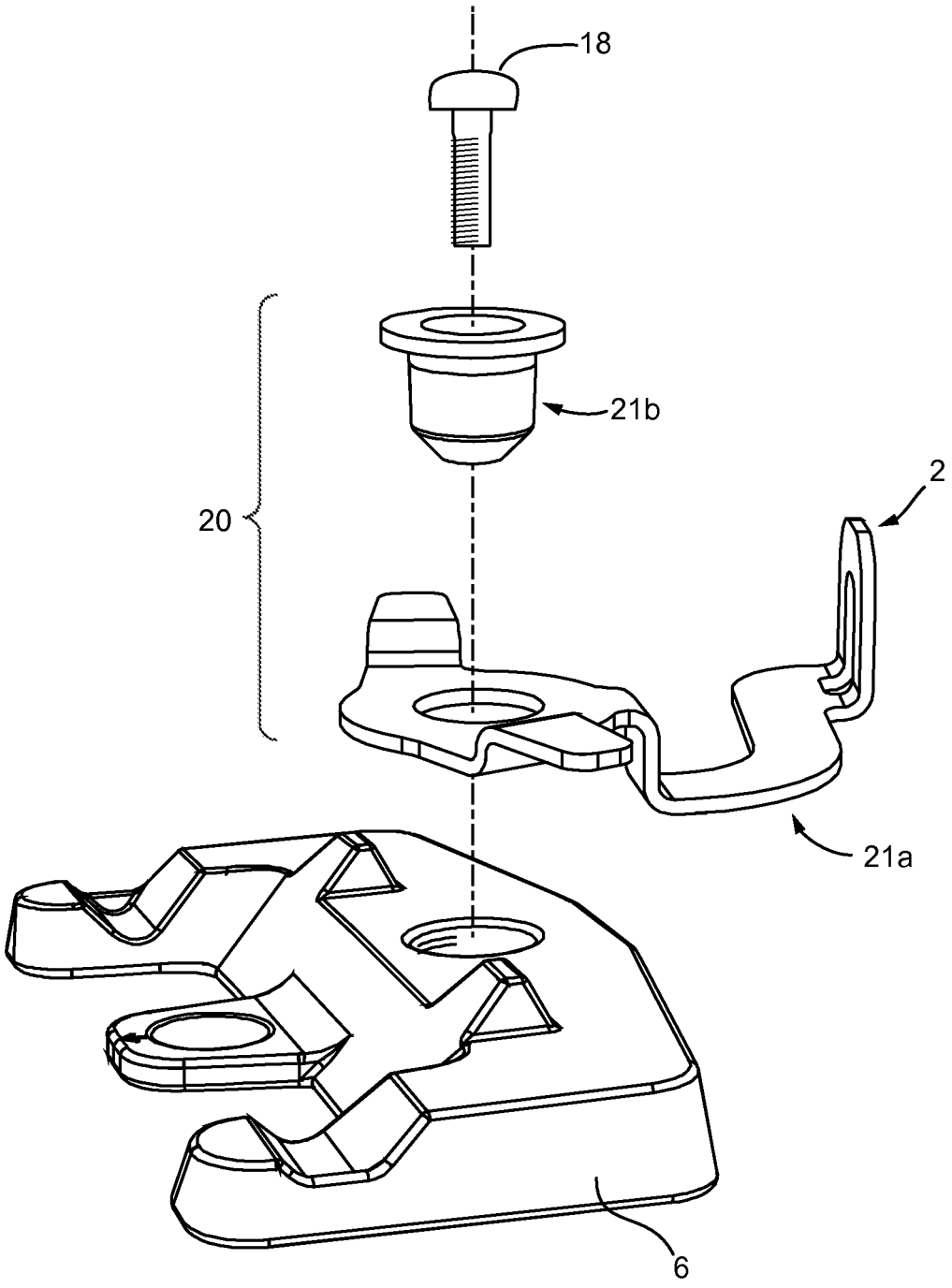
FIG. 9 is an exploded view of the first exemplary spring clamp assembly as rotatably mounted in the heel rest bracket.

FIG. 9 is an exploded view, showing assembly of the spring clamp assembly 20 on the heel rest 6. The assembly 20 consists of a butterfly spring member 21*a* and a hub member 21*b*. The sub-assembly is affixed to the heel rest bracket 6 by a stem bolt 18 so that the butterfly clamp can be turned on the hub bearing flat (top face). Lever arm 2 is used to lock and unlock the heel end of the baseplate. Generally the heel rest is made of nylon, and the aluminum hub does not rotate on its own due to the frictional contact with the nylon walls of the mounting well. The butterfly clamp is restrained from freely spinning by the clamping force of the stem bolt against the hub bearing flat, but may be repositioned from the locked to the unlocked position using the lever.

Advantageously, the stem bolt replaces a center screw of the heel rest bracket, so that the heel lock is a "bolt-on" retrofit and requires no modification of the splitboard or existing ski-mode hardware when used with a mating baseplate and heel rest. Thus the heel lock device may be sold as a kit and may be installed as an aftermarket upgrade by the rider without the need for drilling.

Figure 10A:
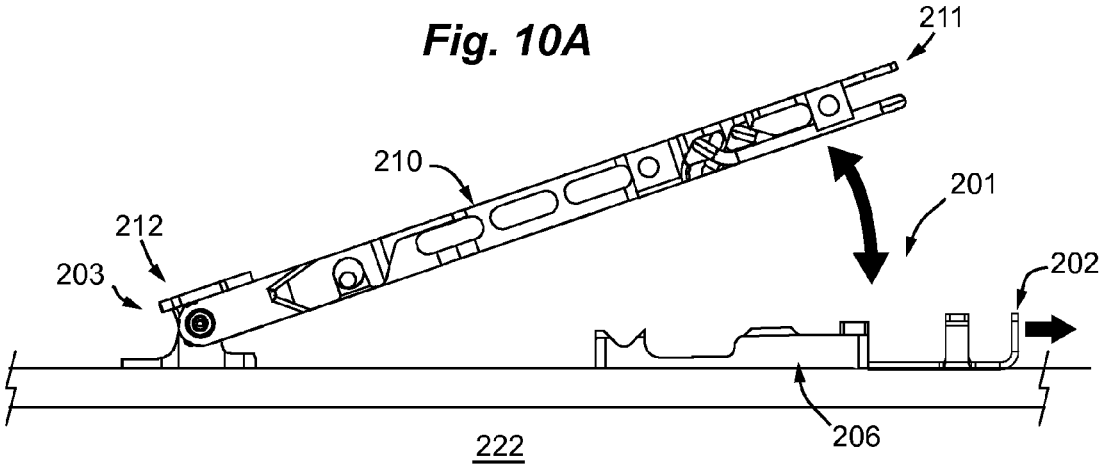
FIGS. 10A, 10B and 10C are elevation and plan views of a second heel lock and release combination on a ski touring interface, showing the toe pivot arrest and release action and a cutline for the sectional plane depicted in FIG. 11.
Figure 10B:
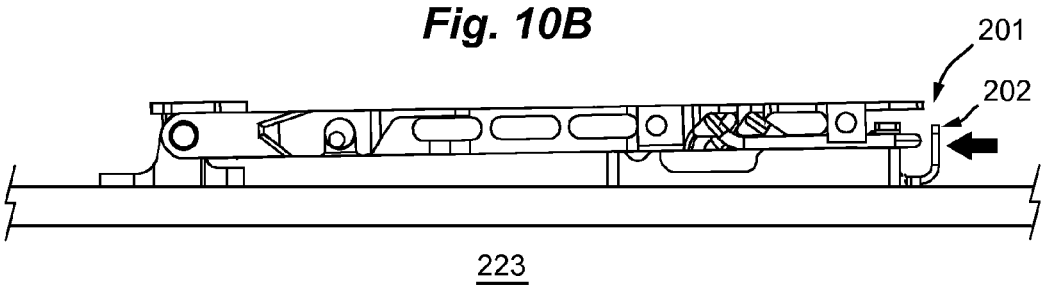
Figure 10C:
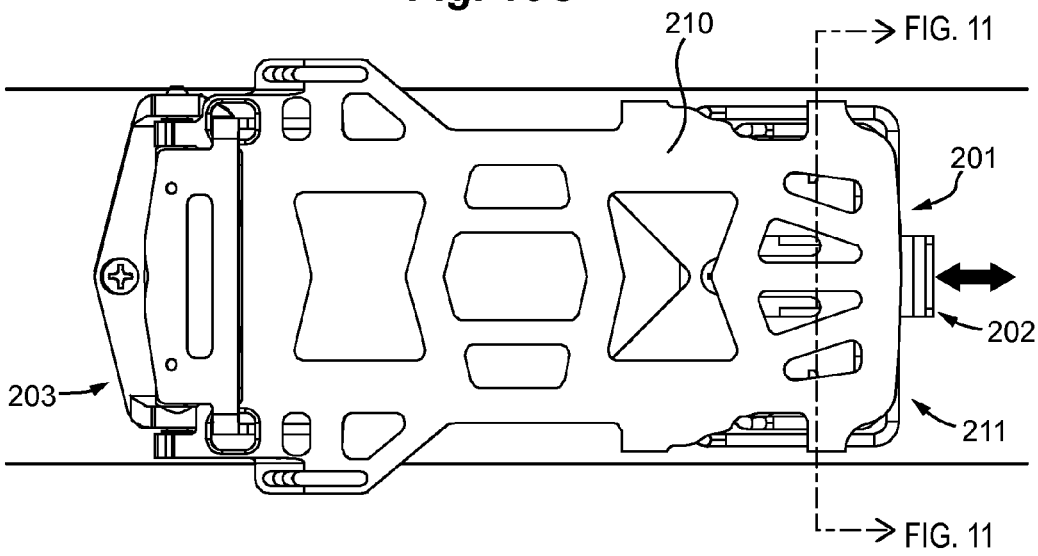

FIGS. 10A, 10B and 10C show yet another exemplary boot binding baseplate assembly on a ski touring interface, shown here with a heel lock and release combination 201 of the invention. The mechanism is provided with a sliding heel lock selector tab 202 and spring clamp for reversibly securing and releasing the rider's heel. The spring clamp is mounted in a heel rest 206. A toe pivot assembly 203 is provided as before and the combination is used for free-heel skiing, fixed heel skiing, and climbing with a heel lock engaged. When a pull force on the heel exceeds a critical threshold, the spring clamp lock is released.

Drawn is a boot binding baseplate 210 in a "free heel position" 222 and a "heel lock position" 223, demonstrating the toe pivot action of the boot binding on the ski member (bold arrow). The boot binding baseplate includes a heel end 211 and a toe end 212 and is dimensioned to support a rider's boot. The heel lock and release assembly 201, a sliding heel lock lever or "selector tab" 202 and heel rest bracket 206 are shown in side view and are described in more detail in the following illustrations. As drawn here, the toe pivot assembly 203 includes a toe pivot cradle, toe pivot ears, a latch pedal and pintle pins as described in US Pat. Appl. Publ. No. 2014/0210187, titled "Boot Binding System with Foot Latch Pedal" which is co-owned and co-pending. Also shown is a cutline for the sectional plane depicted in FIG. 11.

Figure 11:
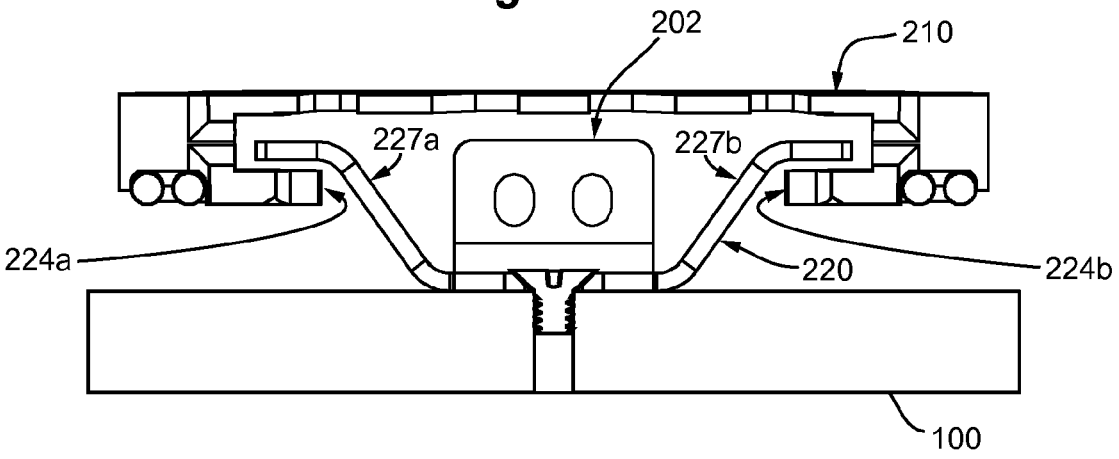
FIG. 11 is a view illustrating a slideable heel lock mechanism from inside. The heel rest bracket is omitted for clarity.

FIG. 11 illustrates the heel lock and release mechanism would be seen from a cross-section plane as viewed toward the heel. The heel rest bracket is omitted for clarity so that the spring clamp 220 and inferior flanges on the baseplate (with anchor teeth 224*a*, 224*b*) are distinctly visible. The inferior flanges and anchor teeth are symmetrically disposed on either side of the baseplate such that a channel runs down the underside middle. The heel lock and release mechanism is mounted in this channel under the heel end 211 of the baseplate 210 (seen in plan view in FIG. 10C). The selector tab 202 is positioned behind the baseplate and may include a stringloop so that a ski pole can be used to slide the tab in and out. The spring clamp includes two bent or "folded" spring arms or "prongs" (227*a*, 227*b*) configured to seat at their tip ends on the anchor teeth when the heel is locked down onto the ski. The spring clamp is mounted in a slot in the heel rest bracket and slides on a pair of screws mounted to the ski 100. This setup may be retrofitted onto existing ski members from most splitboard manufacturers but requires a mating baseplate having a compatible underside channel with internal underside flanges and compatible anchor teeth, such as made by Spark R&D (Bozeman, Mont.).

Figure 12A:
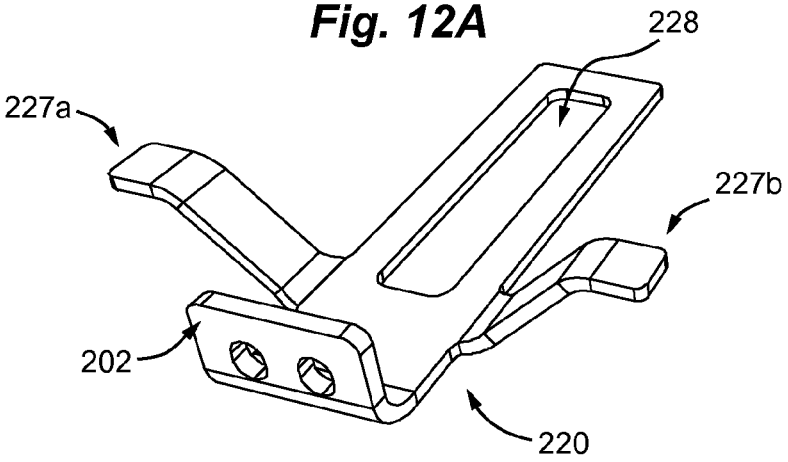
FIGS. 12A and 12B are perspective views showing a slideable spring clamp member with spring arms, selector tab, and center slot.
Figure 12B:
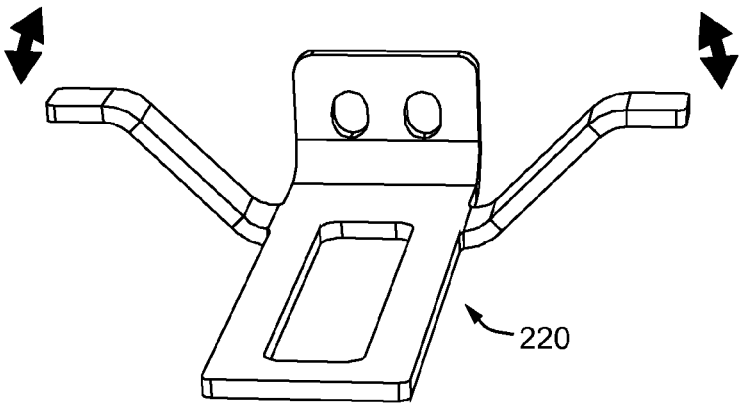

FIGS. 12A and 12B are perspective views showing the spring clamp body 220 with leaf spring arms 227*a*, 227*b*, heel lock selector tab 202 used to slide the spring clamp in and out of engagement, and a center slot or "guide slot" 228 on which the spring clamp body slides. Bold double-headed arrows indicate the spring action of the spring arms. The elasticity of the spring material, thickness, work hardening, and dimensions of the folded leaf spring arms are configured to release from the anchor teeth at a defined critical threshold of pull force applied to the rider's heel.

Figure 13:
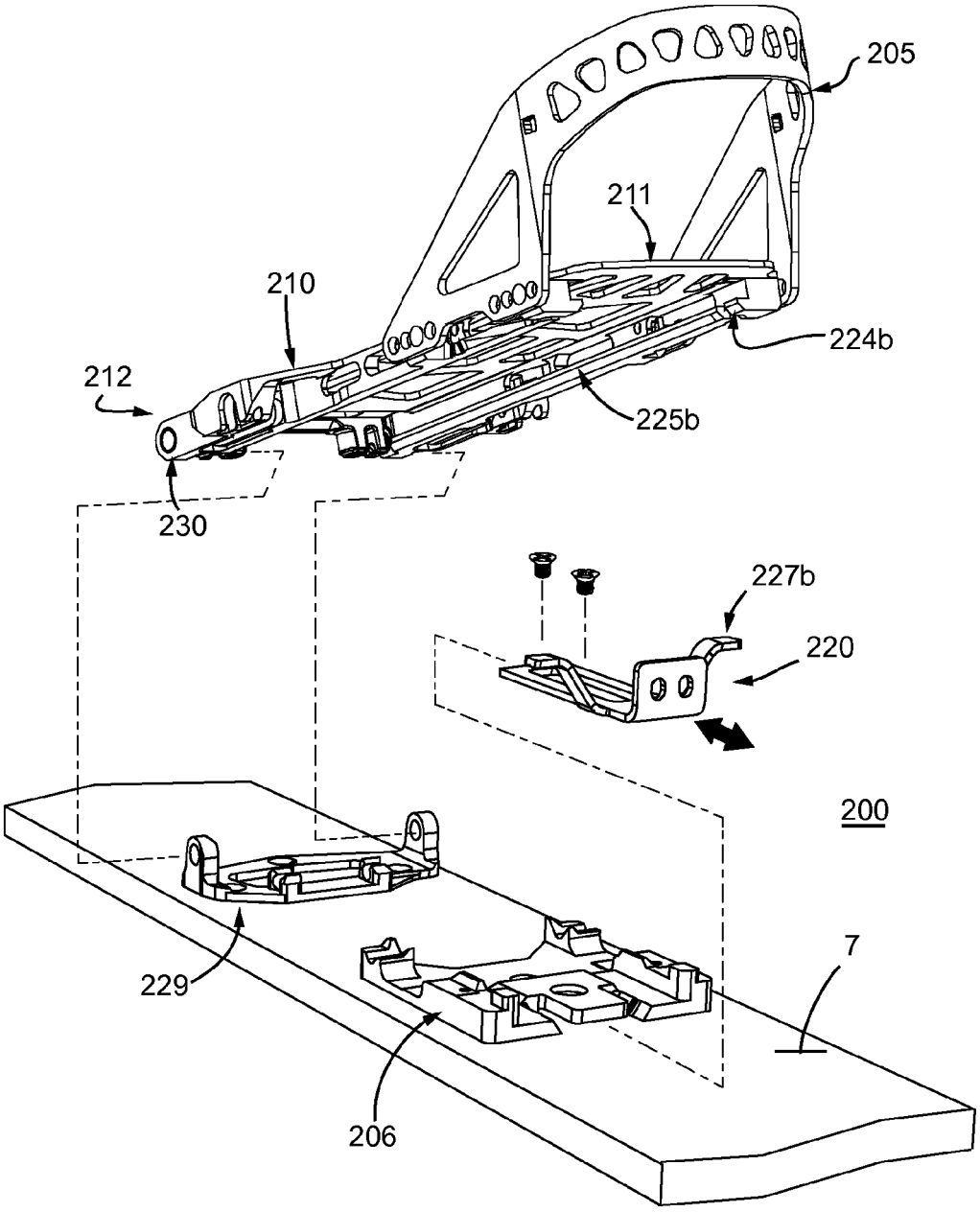
FIG. 13 is an exploded view of an exemplary slideable heel lock and release combination.

FIG. 13 is an exploded view of a slideable heel lock and release combination 200 with a boot binding baseplate and ski touring interface. The spring clamp body 220 is formed from spring steel and includes two prongs, each prong having a tip end that engages an anchor tooth (224*a*, 224*b*) on the underside of the baseplate 210 at the heel end 211. The underside flanges 225*b* of the baseplate are visible in this view. The stiffness and elasticity of the spring arms is configured so that the tip ends 227*b* slip off the anchor teeth at any time a critical pull force on the heel is exceeded. Curling the tip ends may be used to increase the cold worked strength of the tip ends and eases release and insertion into the locking position in the groove formed above the teeth. Curling also blunts the tip edges of the spring clamp arms.

Unless locked, the baseplate is free to rotate at toe pivot ears 230. Pivot pins mounted in the toe pivot ears 230 of the baseplate engage pivot holes in a toe pivot cradle bracket 229 of the ski touring interface. But if the heel is locked down, any excessive pull force as the rider falls forward on the ski tip angles up will stretch the rider's Achilles tendon. Thus the need for a heel lock and release combination of the embodiments of the invention.

The heel rest bracket 206 is attached to the top surface 7 of the ski member. The bracket includes an underside channel for receiving the spring clamp body and permits the spring clamp to slide in and out so as to engage or disengage the anchor teeth. The bracket holds the spring clamp in place and resists any force applied to the spring clamp body unless the force exceeds a characteristic stiffness of the spring arms and tip ends 227*b*. Also shown in this view is a heel cup 2054. Not shown are conventional toe and ankle straps used to secure the rider's boot to the baseplate and an optional highback that provides additional ankle support.

Locking down the heel is also helpful in climbing, such as sidestepping up steep slopes or using climbing skins. The climbing skins may catch, causing the rider to pitch forward, and use of a heel lock stabilizes the rider and gives more control. Thus a solution to the issues of control and safety is presented by a heel lock mechanism that includes a safety release as provided here.

Figure 14:
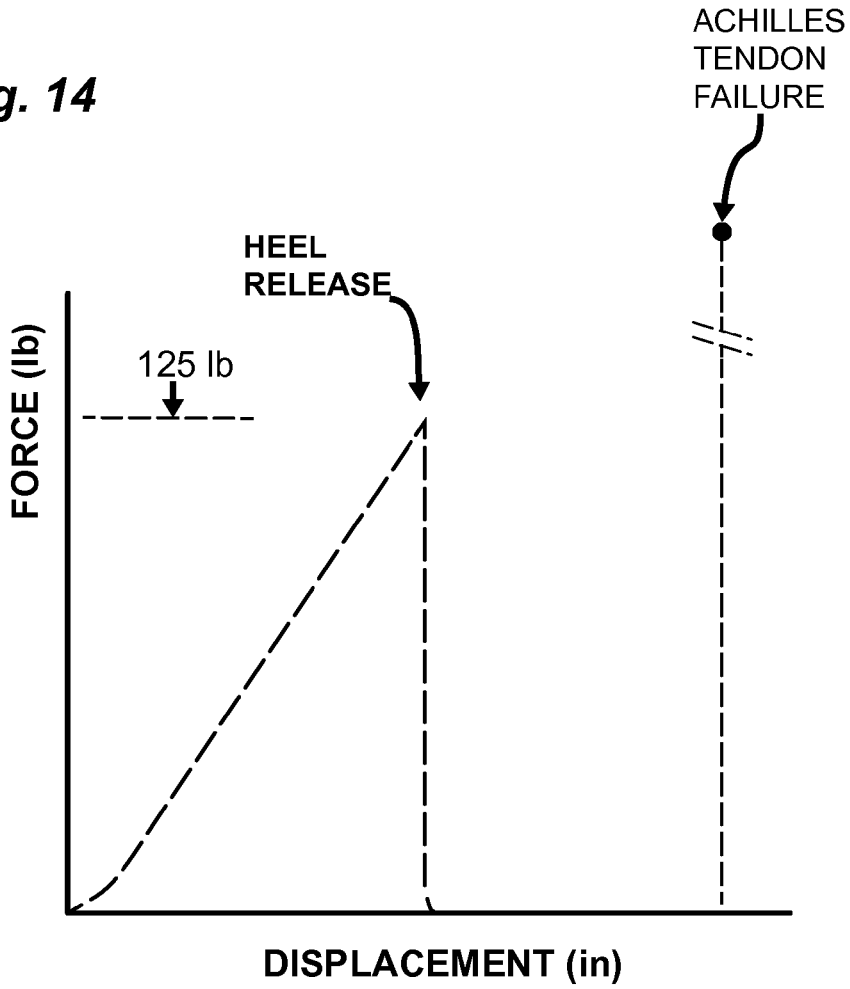
FIG. 14 is a force-displacement plot for a spring steel clamp.

FIG. 14 is a force-displacement plot for a spring steel clamp. The spring clamp prongs and mating teeth of the baseplate are dimensioned and treated so that a non-destructive separation occurs when a "release force" of about 125 lb is applied, causing the baseplate to pivot in an upward direction. Displacement refers to the lift of the heel above the heel rest bracket on the spring arms leading to release. This limit was determined by trials under field conditions as described in EXAMPLE 1.

Also shown for comparison is a representative failure strain of a human Achilles tendon. Per literature reports, ultimate failure strain is about 1200 N (LOUIS-UGBO, J et al, 2004, Tensile properties of fresh human calcaneal (Achilles) tendons, Clin Anat 17:30-35). Failure strain was reported to be reached at about 9.9% of tendon length at 10%/sec, a relatively slow rate of extension (WREN, T et al, 2001, Mechanical properties of the human Achilles tendon, Clin Biomech 16:245-51). While not bound by theory, a rapid 10% extension over the lower 15 cm of isolated ligament is prevented by configuring a heel release with spring clamp release at about <1.5 cm of displacement. As currently practiced, release occurs with about 1.4 cm (~0.56 inches) of deformation of the spring and would correspond to the entire bone/ligament/muscle complex. Taking the bone-tendon complex, failure strain occurs at 16.1%, suggesting a substantial safety margin, not including live muscle. Thus the experimentally derived value is within the range of biomechanical measurements made by Wren and Louis-Ugbo. The spring material is configured to release before an injurious biomechanical limit on extension is likely, while maintaining a practical degree of rigidity in the heel lock position such that inadvertent and premature release is not expected.

FIG. 15 depicts a yoke spring clamp having an elbow for reversibly disengaging and engaging according to the direction of a pull force on the spring arms. An end view of a heel lock and release mechanism is shown, the mechanism having a dual action spring yoke (double arrows). The yoke 280 is configured with rounded or optionally curled tip ends to engage the flange anchor teeth 224*b* of flange 225*a* when the baseplate 210 is pressed down onto it, thus locking the heel in place and seating itself, and is configured to release the heel when a sufficient upward pull force is applied.

As the heel is pulled upwards, its displacement is opposed by the spring and if the pull force is below the release threshold, then the spring will recover, restoring the heel to its lock position against the ski. The performance of the heel lock is controlled by the dimensions, geometry, work hardening, and by the elastic modulus of the spring material. Analogous to the setup of FIG. 13, the yoke-type heel lock may be provided with a selector tab with slider action so that the heel lock and release combination may be entirely disengaged for free heel skiing. A heel rest bracket is not shown for clarity in this view but may be provided as per of the bracket 206 shown in FIG. 13.

In yet other embodiments, the spring clamp is moveable by bending, such as the compression of a coil spring so as to engage a cam pin, whereby the coil spring will ride up on the cam pin as a release force is applied. In this embodiment, the critical limit for release is adjustable, as by a tightening action applied to the coil spring against the cam pin. However, field testing suggests that an optimal setting is around 125 lb and adjustments up from this threshold would only be appropriate for more skilled or physically fit riders.

EXAMPLE 1

A variety of metals were tried in order to discover a spring material that functioned properly. Further experimentation was then needed to determine a "release force" at which the heel snaps free. By trial and error, a release force of about 125 lb was found to offer a suitable compromise between safety and the inconvenience of suddenly having to catch one's balance or being flat on the snow when the heel lock releases. A series of spring clamp bodies having "folded" leaf spring arms of the kind shown in FIGS. 6A and 12A were made of 17-4 stainless steel, each having thicknesses in about 0.01" increments, were tested. Each was laser cut to a standard outline and the bends were made by metallurgical techniques known in the art. Individual spring clamp assemblies were then tested multiple times and a preferred snap release was found that performed best. SS-300 series stainless steel was not satisfactory. The preferred material and thickness was then put in a jig and was determined to break away with a release force of about 125 lb (about 556 Newtons), corresponding to a deformation of about 0.56 inches. A lower release limit or "snap-release threshold" could result in inadvertent release. A higher release threshold could result in insufficient protection against injury. Generally the yield point of the spring material is higher than the deformation required to achieve release. In other words, the elastic modulus region of the stress-strain plot for the material is greater than the critical deformation needed for snap-release, permitting the spring member to be re-used without damage after a release. The stresses in the leaf spring arms are in the elastic range.

INCORPORATION BY REFERENCE

All of the U.S. patents, U.S. patent application publications, U.S. patent applications, foreign patents, foreign patent applications and non-patent publications referred to in this specification and related filings are incorporated herein by reference in their entirety.

SCOPE OF CLAIMS

Having described the invention with reference to the exemplary embodiments, it is to be understood that it is not intended that any limitations or elements describing the exemplary embodiments set forth herein are to be incorporated into the meanings of the patent claims unless such limitations or elements are explicitly listed in the claims. Likewise, it is to be understood that it is not necessary to meet any or all of the identified advantages or objects of the invention disclose herein in order to fall within the scope of any claims, since the invention is defined by the claims and inherent and/or unforeseen advantages of the present invention may exist even though they may not be explicitly discussed herein.

While the above is a complete description of selected, currently preferred embodiments of the present invention, it is possible to practice the invention use various alternatives, modifications, combinations and equivalents. In general, in the following claims, the terms used in the written description should not be construed to limit the claims to specific embodiments described herein for illustration, but should be construed to include all possible embodiments, both specific and generic, along with the full scope of equivalents to which such claims are entitled. Accordingly, the claims are not limited by the disclosure.

REFERENCE NUMBERS OF THE DRAWINGS

1 Heel lock and release combination
2 Heel lock lever
3 Toe pivot assembly
5 Heel cup
6 Heel rest bracket
7 Ski top face
10 Boot binding baseplate
10*a* Top plate of section
11 Heel end of baseplate
12 Toe pivot end of baseplate
13 Toe pedal
18 Stem bolt
20 Butterfly spring clamp and hub sub-assembly
21*a* Butterfly spring member
21*b* Butterfly folded spring arms with lever arm
22 "Free heel position"
23 "Heel lock position"
24*a*/24*b* Flange anchor teeth
25 Web member of baseplate
25*a* Baseplate inferior flange
26 Underside channel in baseplate
27*a*/27*b* Prongs or "wings" of butterfly spring clamp
28*a*/28*b* Interference seat
29 Alternate spring member
30 Toe cradle pivot bracket or "cradle"
100 Ski member
101 Splitboard
102 Boot binding
103*a*/103*b* Ski touring interface toe pivot bracket
104 Ski touring interface with boot binding
105*a*/105*b* Slider puck
106*a*/106*b* Ski touring interface heel rest bracket
107*a*/107*b* Snowboard ride interface with boot binding
200 Heel lock and release combination with boot binding
201 Heel lock and release combination
202 Heel lock selector tab
203 Toe pivot assembly
205 Heel cup
206 Heel rest bracket
210 Boot binding baseplate
211 Heel end of baseplate
212 Toe pivot end of baseplate
220 Slideable spring clamp body
222 "Free heel position"
223 "Heel lock position"
224*a*/224*b* Flange anchor teeth
225*a*/225*b* Internal flange

227*a*/227*b* Arms or "prongs" of leaf spring spring clamp body

228 Center slot

229 Toe pivot bracket

230 Toe pivot ears of baseplate

280 Dual action spring clamp with yoke arms

I claim:

1. A ski touring interface for use with a splitboard binding, said ski touring interface comprising a heel lock and release combination having a boot binding with baseplate member, wherein said baseplate is adapted to pivot at a toe end, to receive a rider's boot on a top surface, and to engage a snowboard ride interface, said baseplate having an underside channel defining at least one underside flange with anchor tooth at a heel end thereof;

further characterized by a heel rest bracket mounted under said heel end of said boot binding baseplate;

a leaf spring clamp moveably positionable on said heel rest bracket;

wherein said leaf spring clamp is moveably positionable between a heel lock position and a free heel position such that said leaf spring clamp is configured to engage said at least one underside anchor tooth in said heel lock position; and to release said at least one underside anchor tooth from said heel lock position when a rider's heel is subjected to a critical pull force;

and, further wherein said leaf spring clamp is engagable by a rotating motion, a bending motion, or a sliding motion.

2. The apparatus of claim 1, wherein said leaf spring clamp is a spring steel spring with at least one folded spring arm having at least one tip end configured to engage said underside anchor tooth in said heel lock position.

3. The apparatus of claim 1, wherein said spring clamp comprises at least one spring arm with a tip end configured to seat on said at least one underside anchor tooth in said heel lock position, further wherein said tip end or ends are configured to elastically deform so as to unseat from said anchor tooth or teeth when stressed by a critical pull force exceeding a safety limit defined as a force below the tensile failure strength and stretchability of a rider's Achilles tendon.

4. The apparatus of claim 3, wherein said critical pull force is about 125 lb (556 Newtons).

5. The apparatus of claim 3, wherein said tip end or ends are movable between a heel lock position and a free heel position by a sliding motion on said heel rest bracket.

6. A method for preventing a tear of an Achilles tendon when riding in a heel lock position on a ski touring interface of a splitboard, said method comprising providing a ski touring interface of claim 1 for use with a splitboard binding, said ski touring interface having a heel lock and release combination, said heel lock and release combination having a leaf spring clamp configured to release a heel end of said binding when subjected to an unsafe critical pull force at the heel thereof.

7. The method of claim 6, further comprising configuring the spring clamp with arms having tip ends for elastically disengaging a boot binding from a heel lock position when said spring clamp arms are subjected to a pull force exceeding about 125 lb.

8. The method of claim 6, further comprising securing said boot binding to said ski touring interface; strapping a boot to said boot binding; and, locking said boot binding in said heel lock position by engaging said spring clamp in said heel lock position.

9. The method of claim 8, further comprising riding on or climbing with a splitboard with said boot binding engaged in said heel lock position.

10. The apparatus of claim 1, wherein said underside channel defines two underside flanges contralaterally disposed thereon, said two underside flanges having each an anchor tooth at said heel end thereof.

* * * * *